United States Patent [19]

Toriyama

[11] Patent Number: 4,746,925

[45] Date of Patent: May 24, 1988

[54] SHIELDED DIPOLE GLASS ANTENNA WITH COAXIAL FEED

[75] Inventor: Haruhiko Toriyama, Toyota, Japan

[73] Assignee: Toyota Jidosha Kabushiki Kaisha, Toyota, Japan

[21] Appl. No.: 889,465

[22] Filed: Jul. 25, 1986

[30] Foreign Application Priority Data

Jul. 31, 1985 [JP] Japan ..... 60-117809[U]
Aug. 2, 1985 [JP] Japan ..... 60-171369

[51] Int. Cl.[4] ..... H01Q 1/32
[52] U.S. Cl. ..... 343/713; 343/700 MS; 343/793
[58] Field of Search ..... 343/700 MS File, 711, 343/712, 713, 792, 793, 821, 859; 333/26, 246

[56] References Cited

U.S. PATENT DOCUMENTS

| | | | |
|---|---|---|---|
| 3,835,421 | 9/1974 | DeBrecht et al. | 333/246 |
| 3,845,490 | 10/1974 | Manwarren et al. | 343/821 |
| 4,160,977 | 7/1979 | Davis | 343/713 |
| 4,495,505 | 1/1985 | Shields | 343/821 |

*Primary Examiner*—William L. Sikes
*Assistant Examiner*—Doris J. Johnson
*Attorney, Agent, or Firm*—Cushman, Darby & Cushman

[57] ABSTRACT

A glass antenna for a vehicle includes a pair of dipole antenna elements, a central lead wire out from one end of either one of the dipole antenna elements, a first shielding lead wire led out from one end of the other dipole antenna element, a second shielding lead wire extending so as to interpose the central lead wire between the same and the first shielding lead wire, and a pair of balanced-to-unbalanced transformers branching off from the respective intermediate portions of the first and second shielding lead wires. Accordingly, washing and garaging of the vehicle are facilitated.

18 Claims, 5 Drawing Sheets

SHIELDED DIPOLE GLASS ANTENNA WITH COAXIAL FEED

BACKGROUND OF THE INVENTION

1. Field of the Invention

The present invention relates to a glass antenna which may be employed for, e.g., a radio set for personal radio communications service or a car telephone system which is mounted on an automobile, as an antenna which serves for both transmission and reception in the UHF band (300 to 3,000 MHz). More particularly, the present invention pertains to a glass antenna formed on the surface of glass mounted on a vehicle such as a window glass.

2. Description of the Related Art

One type of antenna which utilizes the surface of glass has already been put into practical use as an antenna employed exclusively for reception in the VHF band. Since this type of antenna has a relatively low gain and an unfavorably large VSWR (voltage standing-wave ratio), it has heretofore been impossible to apply such an antenna to the UHF band in a simple way and for both transmission and reception.

For this reason, it is general practice to adopt vertical rod antennas for equipment for personal radio communications service (service band: 903 to 905 MHz) and car telephones mounted on automobiles.

Rod antennas which project outward from the bodies of automobiles involve the following problems: hindrance to washing and garaging of the cars; the fear of rod antennas being stolen or broken; the noise generated by such antennas when the automobile is moving and the adverse effect on the external appearance of the cars.

SUMMARY OF THE INVENTION

In view of the above-described circumstances, it is a primary object of the present invention to provide a glass antenna which has no projection and yet has characteristics substantially the same as those of a rod antenna and which can readily be produced.

To this end, the present invention provides a glass antenna formed in a pattern on the surface of glass mounted on a vehicle and connected to a feeder, which comprises: a pair of dipole antenna elements disposed so as to extend in a predetermined direction; a central lead wire led out from one end of either one of the dipole antenna elements in a direction substantially perpendicular to the longitudinal axis of the antenna element; a first shielding lead wire led out from one end of the other dipole antenna element in a direction substantially perpendicular to the longitudinal axis of the antenna element; a second shielding lead wire disposed in such a manner that it extends substantially parallel with the central lead wire and the first shielding lead wire so as to interpose the central lead wire between the same and the first shielding lead wire; and a pair of balanced-to-unbalanced transformers branching off from the respective intermediate portions of the first and second shielding lead wires so as to extend near the pair of dipole antenna elements.

By virtue of the above-described arrangement, washing and garaging of the vehicle are facilitated, and it is also possible to prevent the antenna from being stolen or broken and eliminate the problem of noise and the adverse effect of the conventional rod antenna on the external appearance of the vehicle.

In addition, since the dipole antenna as a whole is formed in a pattern on the surface of glass, the production of the antenna is facilitated. In particular, since the dipole antenna pattern can be printed simultaneously with the formation of a defogger pattern, it is possible to reduce the time required for assembling and also lower the production cost in contrast to the manufacture of a vehicle using a rod antenna. Further, the balanced-to-unbalanced transformers are formed in a pattern on the surface of the glass together with the antenna elements. It is therefore unnecessary to provide any balanced-to-unbalanced transformer separately, so that the production cost can be further reduced and the assembling operation is facilitated.

DESCRIPTION OF THE PREFERRED EMBODIMENTS

Figure 1:
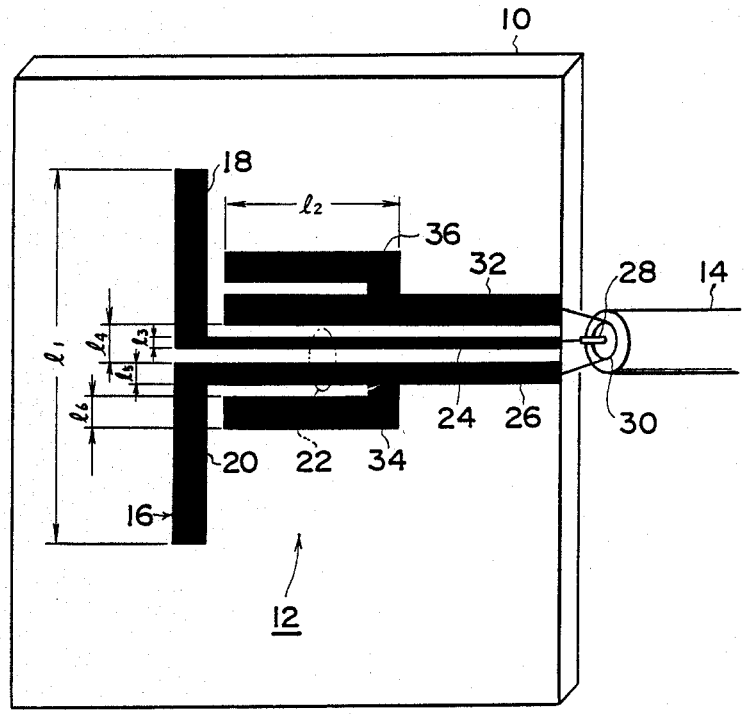
FIG. 1 schematically shows the basic arrangement of a first embodiment of the glass antenna according to the present invention.

A first embodiment of the present invention will be described hereinunder with reference to the accompanying drawings. FIG. 1 schematically shows the basic arrangement of a first embodiment of the glass antenna according to the present invention.

A dipole antenna pattern 12 for both transmission and reception in the UHF band is provided on the surface of a window glass 10 of an automobile. This dipole antenna pattern 12 is connected to a radio set (not shown) by a coaxial feeder 14. The dipole antenna pattern 12 as a whole is formed on the glass 10 which serves as a substrate by pasting, evaporation, printing or other similar means.

The dipole antenna pattern 12 has an antenna portion 16 which is constituted by a pair of dipole antenna elements 18, 20 which extend so as to define a vertical straight line. Vertically providing the antenna portion 16 in this way makes uniform the directivity within the horizontal plane.

A lead portion 22 extends from the center of the antenna portion 16 in a direction perpendicular to the longitudinal axis of the antenna portion 16 as far as one end of the glass 10. This lead portion 22 consists of a central lead wire 24 and a shielding lead wire 26 which are parallel to each other and respectively connected to the inner ends of the dipole antenna elements 18 and 20. The central lead wire 24 is connected to a central wire 28 of the coaxial feeder 14, and the shielding lead wire 26 is connected to a shielding wire 30 of the coaxial feeder 14.

Another shielding lead wire 32 is provided on the side of the central lead wire 24 which is remote from the shielding lead wire 26 in such a manner that the shielding lead wires 26 and 32 interpose the central lead wire 24 therebetween. The shielding lead wire 32 extends from a position near the dipole antenna element 18 to the end of the glass 10 in parallel with the central lead wire 24 and the shielding lead wire 26.

The shielding lead wire 32 is connected to the shielding wire 30 of the coaxial feeder 14. Thus, the shielding lead wires 26, 32 and the central lead wire 24 form in combination a planar structure which is equivalent to the structure of the coaxial feeder 14. The shielding lead wire 32 is provided so as to cooperate with the shielding lead wire 26 to shield the central lead wire 24 in order to improve the SN ratio and other electric characteristics of the glass antenna.

Baluns (balanced-to-unbalanced transformers) 34 and 36 are respectively provided on the shielding lead wires 26 and 32 in such a manner that the baluns 34 and 36 branch off from the intermediate portions of the shielding lead wires 26 and 32 in the downward and upward directions, respectively, at right angles and bend in the shape of an L so as to extend parallel with the lead wires 26 and 32 to positions near the dipole antenna elements 20 and 18.

In the dipole antenna pattern 12 arranged as detailed above, the dimensions of each of the portions thereof are determined as follows.

The length $l_1$ of the antenna portion 16 (the size of half-wavelength) is represented by the following equation:

$$l_1=(150/f)\cdot K \quad (1)$$

where $K=1/\sqrt{\epsilon_s}$ f: service frequency

K: shortening coefficient of wavelength $\epsilon_s$: specific dielectric constant of dielectric (glass)

However, the equation (1) holds when an antenna element is sheathed in a substance having a specific dielectric constant $\epsilon_s$, and is not applicable in the case where the antenna portion 16 is disposed on the surface of the glass 10 as shown in FIG. 1.

Therefore, the present inventor changed $l_1$ shown in FIG. 1 to find the value of $l_1$ and which the antenna gain G is the largest and calculated an apparent shortening coefficient of wavelength K' and an apparent specific dielectric constant $\epsilon_s'$ from the obtained value of $l_1$ reversely, and has found that, when the thickness t of the glass 10 is 4 to 15 mm and $\epsilon_s$ is approximately equal to 6, $\epsilon_s'\approx 0.5\epsilon_s$ and $K'\approx 0.57$. Therefore, the equation (1) may be rewritten as follows:

$$l_1=(150/f)(1/\sqrt{\alpha\epsilon_s}) \quad (2)$$

where $\alpha$ is about 0.5 in the case of glass mounted on a vehicle. Accordingly, the length $l_1$ should be set according to the equation (2).

The length $l_2$ of each of the baluns 34 and 36 is a half of the overall length of the antenna and is therefore set such as to be $\frac{1}{2}$ of $l_1$ which is obtained from the equation (2).

Figure 2:
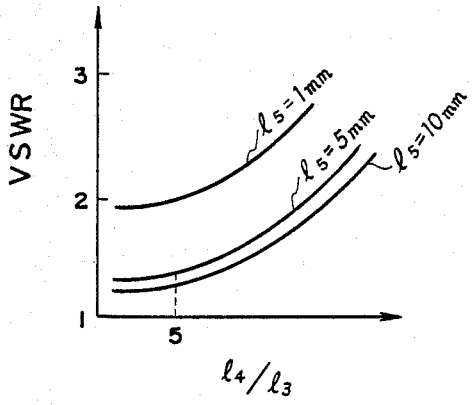
FIG. 2 is a graph showing the relationship between the dimensions of an antenna pattern and VSWR.

The width $l_3$ of the central lead wire 24, the spacing $l_4$ between the shielding lead wires 26 and 32, and the width $l_5$ of the shielding lead wire 32 are all related to VSWR. FIG. 2 shows the relationship between $l_4/l_3$ and VSWR in the case where $l_5$ is used as a parameter and the conditions are such that the thickness t of the glass 10 is 4 to 15 mm and $\epsilon_s$ is approximately equal to 6.

The smaller VSWR, the better the antenna characteristics. For example, when $l_5\approx 5$ mm, if $l_4/l_3\approx 5$, then VSWR$\leqq 1.5$, which means that the antenna is practicable as an antenna for both transmission and reception. It should be noted that the width $l_6$ of each of the baluns 34 and 36 is set such as to be substantially equal to $l_5$.

Figure 3:
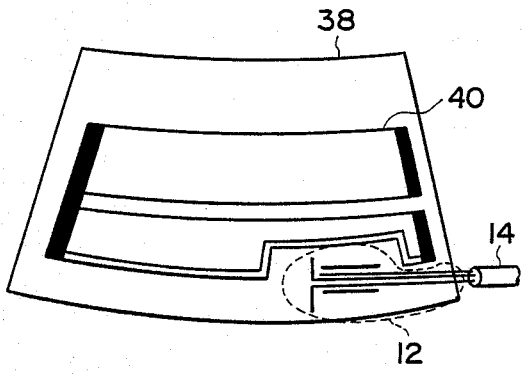
FIG. 3 schematically shows one example in which the glass antenna according to the present invention is provided on the rear window of a vehicle.

FIG. 3 schematically shows a practical example in which the dipole antenna pattern 12 is provided on the rear window 38 of a vehicle.

Figure 4:
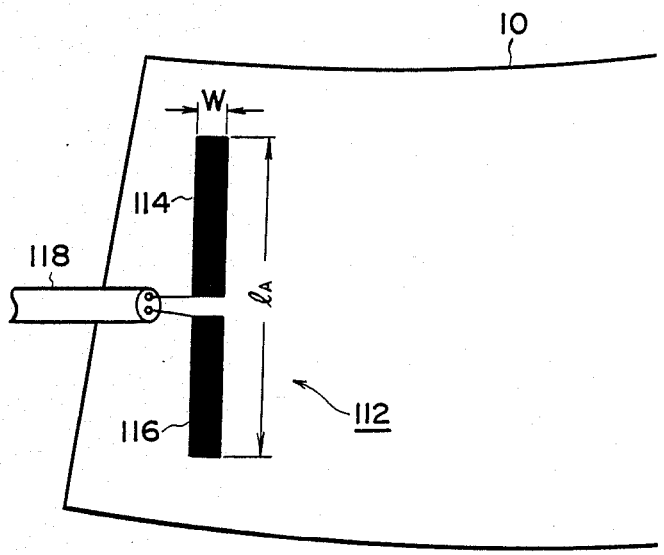
FIG. 4 schematically shows a second embodiment of the present invention.

FIG. 4 shows a second embodiment of the present invention. The illustrated glass antenna may be employed for a personal radio communications service or a car telephone and adapted to serve both for transmission and reception in the UHF band.

Referring to FIG. 4, a dipole antenna 112 is provided on the surface of a window glass 10 for an automobile in such a manner that the antenna 112 extend in a predetermined direction. This dipole antenna 112 has a pair of beltlike antenna elements 114 and 116 which are formed from a transparent electrical conductor such as iridium tin oxide (ITO).

The antenna elements 114 and 116 are rigidly secured to the window glass 10 by pasting, evaporation or other similar means. The dipole antenna 112 arranged as described above is connected to a radio set (not shown) through a parallel feeder 118 which is connected to the central portion of the antenna 112.

The parallel feeder 118 can transmit radio-frequency energy highly efficiently. In transmission, the signal energy delivered from the radio set is radiated as a radio wave from the dipole antenna 112. In reception, the radio wave is caught by the dipole antenna 112 and delivered to the radio set as a radio wave signal.

The transparent electrical conductor which constitutes the dipole antenna 112 has a resistance. Therefore, even when the length $l_A$ of the antenna 112 is set such as to be about $\lambda/2$ ($\lambda$ represents an electrical length of one wavelength determined by the electric conductivity of glass and other factors), the antenna impedance $Z_A$ varies in accordance with the width and thickness of the antenna 112.

On the other hand, the input-output rated impedance of the radio set or the line impedance $Z_0$ of the parallel feeder 118 is predetermined. Therefore, the width and thickness of the dipole antenna 112 are appropriately set so that the impedance of the dipole antenna 112 and that of the feeder line 118 are matched with each other, thereby allowing an improvement in the transmission efficiency.

More specifically, if the width, length, thickness and characteristic resistance of the dipole antenna 12 are represented by w, $l_A$, d and $\rho$, respectively, the direct-current resistance R of the dipole antenna 112 may be expressed as follows:

$$R=\rho\cdot\frac{l_A}{w\cdot d} \quad (3)$$

If the theoretical impedance of the dipole antenna 112, which is measured when the direct-current resistance is ignored, is represented by $Z_{th}$ (it is assumed that the imaginary component of the antenna impedance has already been made zero by adjusting $l_A$), the antenna impedance $Z_A$ may be represented by the following equation:

$$Z_A = R + Z_{th} \quad (4)$$

With the impedance of the feeder 118 represented by $Z_0$, if the following equation holds $$Z_A = R + Z_{th} = Z_0 \quad (5)$$

then, it is possible to obtain impedance matching between the antenna 112 and the feeder 118.

If the equation (3) is substituted into the equation (5), w is obtained from the following equation:

$$w = \frac{\rho \cdot l_A}{d(Z_0 - Z_{th})} \quad (6)$$

Thus, if the width of the dipole antenna 112 is set according to the equation (6), the impedance of the dipole antenna 112 and that of the parallel feeder 118 are matched with each other, so that it becomes unnecessary to provide any impedance corrector.

Figure 5:
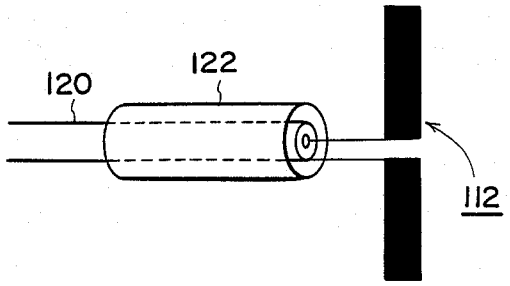
FIG. 5 schematically shows an arrangement in which the feeder employed in the embodiment shown in FIG. 4 is changed.

When a coaxial feeder 120 is employed, as shown in FIG. 5, in place of the parallel feeder 118 in the second embodiment as shown in FIG. 4, a balun 122 (a balanced-to-unbalanced transformer) is interposed. However, in place of the balun 122, a balun in the shape of a pattern may be formed on the surface of glass together with the dipole antenna 112 as in the case of the first embodiment.

Figure 6:
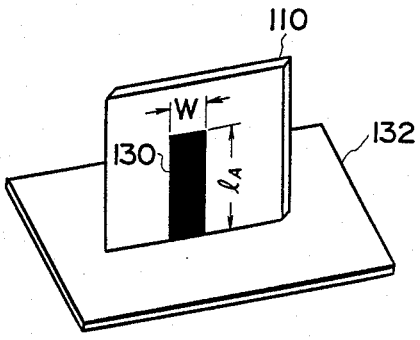
FIG. 6 schematically shows a quarter-wave grounded antenna in accordance with one experimental example of the present invention.

FIG. 6 shows an experimental example in which the glass antenna according to the present invention is applied to a quarter-wave grounded antenna. This quarter-wave grounded antenna is employed to examine the validity of the equation (6).

Referring to FIG. 6, a quarter-wave grounded antenna 130 is provided on the surface of glass 110 in such a manner as to extend in a predetermined direction. This antenna 130 if formed by pasting or evaporating a transparent electrical conductor such as ITO on the surface of the glass 110. The antenna 130 has a beltlike configuration with a length $l_A$, a width w, a thickness d and a resistivity $\rho$. In the experiment, a transparent electrical conductor sheet of $\rho/d = 2.5\Omega$ is employed.

A grounding plate 132 is provided at the lower end of the glass 110.

The length $l_A$ of the quarter-wave grounded antenna 130 is adjusted in advance so that the imaginary component of the antenna impedance is zero.

Figure 7:
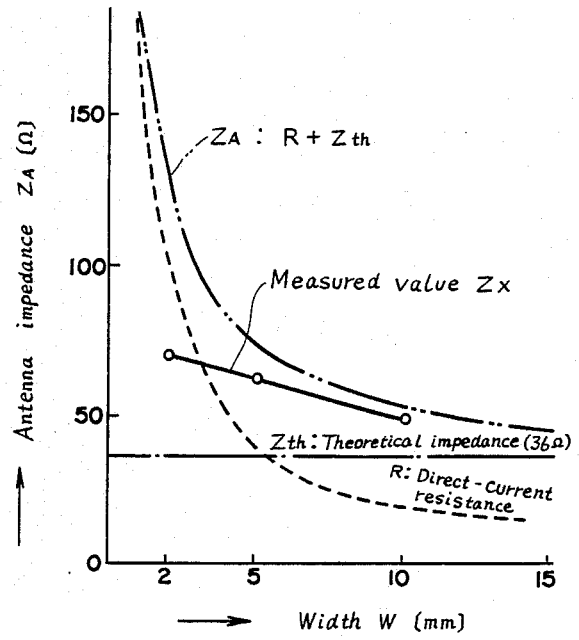
FIG. 7 is a graph showing the relationship between the width of the quarter-wave grounded antenna shown in FIG. 6 and the antenna impedance.

FIG. 7 shows changes in the direct-current resistance R of the quarter-wave grounded antenna 130 and the antenna impedance $Z_A$ in accordance with the change in the width w of the antenna, the antenna impedance $Z_A$ being obtained by adding together the direct-current resistance R and the theoretical impedance $Z_{th}$ measured when the direct-current resistance of the antenna 130 is ignored. In this case, the conditions are as follows:

$$R = \frac{2.5 l_A}{w}\ [\Omega],\ Z_{th} = 36\ [\Omega],\ Z_A = R + Z_{th} \quad (7)$$

FIG. 7 also shows the value $Z_X$ obtained by measuring the actual antenna impedance as the width w of the quarter-wave grounded antenna 130 is changed.

As will be clear from FIG. 7, there is a difference between the tendencies of $Z_A$ and $Z_X$.

However, when the width w is 8 mm or greater, the condition of $Z_X \approx Z_A$ is met. On the other hand, the input-output impedance $Z_0$ of ordinary radio sets having a quarter-wave grounded antenna is generally set such as to be 50, and the width w at which $Z_X = 50$ is about 10 mm as will be seen from FIG. 7, and this satisfies the condition of $w \geqq 8$ mm.

Accordingly, if the value of w at which the condition of $Z_0 = Z_A$ is met is calculated from the equation (7), it is possible to approximately obtain a desired antenna impedance.

When the value of w is made sufficiently large so that the antenna impedance approaches $Z_{th}$, there is substantially no loss. However, in such case, the impedance of the antenna is 36Ω, while the impedance of the radio set is 50, and it is therefore necessary to interpose an impedance corrector therebetween.

On the other hand, if the width w is set at approximately 13 mm, the antenna impedance $Z_A$ becomes approximately 50Ω as shown in FIG. 7, so that it is advantageously possible to eliminate the need for an impedance corrector although the loss is slightly increased as compared with the case where the value of w is made sufficiently large. In addition, the loss at that time is only about 0.5 dB according to the result of measurement of antenna gain, and there is therefore no problem in practical application.

What is claimed is:

1. A glass antenna formed in a pattern on the surface of glass mounted on a vehicle and connected to a feeder, comprising:

(a) a pair of dipole antenna elements having a strip configuration and disposed to longitudinally extend in one direction, said pair of dipole antenna elements forming in combination a substantially straight line between longitudinal axes thereof;

(b) a central lead wire led out from one end of either one of said dipole antenna elements in a direction substantially perpendicular to the longitudinal axis of said antenna element;

(c) a first shielding lead wire led out from one end of the other dipole antenna element in a direction substantially perpendicular to the longitudinal axis of said antenna element and apart from said central lead wire;

(d) a second shielding lead wire disposed in such a manner that it extends substantially parallel with and apart from said central lead wire and said first shielding lead wire so as to interpose said central lead wire between the same and said first shielding lead wire; and (e) a pair of balanced-to-unbalanced transformers branching off from the respective intermediate portions of said first and second shielding lead wires so as to extend adjacent to but apart from respective intermediate portions of said pair of dipole antenna elements, whereby washing and garaging of the vehicle are facilitated.

2. A glass antenna according to claim 1, wherein said feeder is a coaxial feeder.

3. A glass antenna according to claim 1, wherein said glass antenna is constituted by a transparent electrical conductor.

4. A glass antenna according to claim 3, wherein said transparent electrical conductor is iridium tin oxide.

5. A glass antenna rigidly formed in a pattern on the surface of glass mounted on a vehicle and connected to a feeder, said glass antenna comprising:

a pair of strip dipole antenna elements disposed to longitudinally extend for forming in combination a substantially straight line between longitudinal axes thereof, the width w of said antenna elements being set as follows:

$$w = \frac{\rho \cdot l}{d(Z_0 - Z_{th})}$$

where l: the overall length of said antenna elements d: the thickness of said antenna elements $\rho$: the resistivity of said antenna elements $Z_{th}$: the theoretical impedance of said antenna elements $Z_0$: the impedance of said feeder whereby washing and garaging of the vehicle are facilitated.

6. A glass antenna according to claim 5, further comprising:

a central lead wire led out from either one of the respective end portions of said dipole antenna elements on the sides thereof which are close to each other in such a manner that said central lead wire extends in a direction substantially perpendicular to the longitudinal axis of said antenna element;

a first shielding lead wire led out from the end portion of the other dipole antenna element in a direction substantially perpendicular to the longitudinal axis of said antenna element and apart from said central lead wire;

a second shielding lead wire disposed such as to extend substantially parallel with said central lead wire and said first shielding lead wire so as to interpose said central lead wire between the same and said first shielding lead wire; and a pair of balanced-to-unbalanced transformers branching off from the respective intermediate portions of said first and second shielding lead wires so as to extend adjacent to but apart from respective intermediate portions of said pair of dipole antenna elements.

7. A glass antenna according to claim 6, wherein each of said pair of balanced-to-unbalanced transformers is formed such as to have a substantially L-shaped strip configuration.

8. A glass antenna according to claim 7, wherein said feeder is a coaxial feeder, said first and second shielding lead wires being connected to a shielding wire of said coaxial feeder, and said central lead wire being connected to a central wire of said coaxial feeder.

9. A glass antenna formed in a pattern on the surface of glass mounted on a vehicle and connected to a feeder, said glass antenna comprising:

a pair of strip dipole antenna elements disposed to longitudinally extend for forming in combination a substantially straight line between longitudinal axes thereof, the overall length l of said pair of antenna elements is set such as to be $1/\sqrt{\epsilon_s'}$, where $\epsilon_s'$ represents the apparent specific dielectric constant of said glass at which the gain of said glass antenna is the largest, whereby washing and garaging of the vehicle are facilitated.

10. A glass antenna according to claim 9, further comprising:

a central lead wire led out from either one of the respective end portions of said dipole antenna elements on the sides thereof which are close to each other in such a manner that said central lead wire extends in a direction substantially perpendicular to the longitudinal axis of said antenna element;

a first shielding lead wire led out from the end portion of the other dipole antenna element in a direction substantially perpendicular to the longitudinal axis of said antenna element and apart from said central lead wire;

a second shielding lead wire disposed such as to extend substantially parallel with said central lead wire and said first shielding lead wire so as to interpose said central lead wire between the same and said first shielding lead wire; and a pair of balanced-to-unbalanced transformers branching off from the respective intermediate portions of said first and second shielding lead wires so as to extend adjacent to but apart from respective inermediate portions of said pair of dipole antenna elements.

11. A glass antenna according to claim 10, wherein each of said pair of balanced-to-unbalanced transformers is formed such as to have a substantially L-shaped strip configuration.

12. A glass antenna according to claim 11, wherein said feeder is a coaxial feeder, said first and second shielding lead wires being connected to a shielding wire of said coaxial feeder, and said central lead wire being connected to a central wire of said coaxial feeder.

13. A glass antenna formed in a pattern on the surface of glass mounted on a vehicle and connected to a feeder, said glass antenna comprising:

(a) a pair of dipole antenna elements having a strip configuration and disposed to longitudinally extend in one direction for forming in combination a substantially straight line between longitudinal axes thereof;

(b) a central lead wire led out from one end of either one of said dipole antenna elements in a direction substantially perpendicular to the longitudinal axis of said antenna element;

(c) a first shielding level wire led out from one end of the other dipole antenna element in a direction substantially perpendicular to the longitudinal axis of said antenna element and apart from said central lead wire;

(d) a second shielding lead wire in such a manner that it extends substantially parallel with and apart from said central lead wire and said first shielding lead wire so as to interpose said central lead wire between the same and said first shielding lead wire; and (e) a pair of balanced-to-unbalanced transformers branching off from the respective intermediate portions of said first and second shielding lead wires so as to extend adjacent to but apart from respective intermediate portions of said dipole antenna elements, wherein width w of said pair of dipole antenna elements is set as follows:

$$w = \frac{\rho \cdot l}{d(Z_0 - Z_{th})}$$

where l: the overall length of said antenna elements d: the thickness of said antenna elements $\rho$: the resistivity of said antenna elements $Z_{th}$: the theoretical impedance of said antenna elements $Z_0$: the impedance of said feeder, whereby washing and garaging of the vehicle are facilitated.

14. A glass antenna formed in a pattern on the surface of glass mounted on a vehicle and connected to a feeder, said glass antenna comprising:

(a) a pair of dipole antenna elements having a strip configuration and disposed to longitudinally extend in one direction for forming in combination a substantially straight line between longitudinal axes thereof;

(b) a central lead wire led out from one end of either one of said dipole antenna elements in a direction substantially perpendicular to the longitudinal axis of said antenna element;

(c) a first shielding level wire led out from one end of the other dipole antenna element in a direction substantially perpendicular to the longitudinal axis of said antenna element and apart from said central lead wire;

(d) a second shielding lead wire in such a manner that it extends substantially parallel with and apart from said central lead wire and said first shielding lead wire so as to interpose said central lead wire between the same and said first shielding lead wire; and (e) a pair of balanced-to-unbalanced transformers branching off from the respective intermediate portions of said first and second shielding lead wires so as to extend adjacent to but apart from respective intermediate portions of said dipole antenna elements, wherein length l of said pair of dipole antenna elements is set such as to be $1/\sqrt{\epsilon_s'}$, where $\epsilon_s'$ represents the apparent specific dielectric constant of said glass at which the gain of said glass antenna is the largest, whereby washing and garaging of the vehicle are facilitated.

15. A glass antenna according to claim 14, wherein each of said pair of balanced-to-unbalanced transformers is formed such as to have a substantially L-shaped strip configuration.

16. A glass antenna according to claim 5, wherein the length of each of said pair of balanced-to-unbalanced transformers is substantially half the overall length of said pair of antenna elements.

17. A glass antenna according to claim 16, wherein said pair of balanced-to-unbalanced transformers have substantially the same width as each other.

18. A glass antenna formed in a pattern on the surface of glass mounted on a vehicle and connected to a feeder, said glass antenna comprising:

a pair of strip dipole antenna elements disposed to longitudinally extend for forming in combination a substantially straight line between longitudinal axes therefore, the width w of said antenna elements being set as follows:

$$w = \frac{\rho \cdot l}{d(Z_0 - Z_{th})}$$

where l: the overall length of said antenna elements d: the thickness of said antenna elements $\rho$: the resistivity of said antenna elements $Z_{th}$: the theoretical impendance of said antenna elements $Z_0$: the impedance of said feeder wherein length l of said pair of dipole antenna elements is set such as to be $1/\sqrt{\epsilon_s'}$, where $\epsilon_s'$ represents the apparent specific dielectric constant of said glass at which the gain of said glass antenna is the largest, whereby washing and garaging of the vehicle are facilitated.

* * * * *